United States Patent [19]

Smith

[11] 4,145,805

[45] Mar. 27, 1979

[54] METHOD OF MAKING A REED RELAY WITH MOLDED BOBBIN

[75] Inventor: Philip N. Smith, Cincinnati, Ohio

[73] Assignee: Standex International Corporation, Andover, Mass.

[21] Appl. No.: 795,813

[22] Filed: May 11, 1977

[51] Int. Cl.[2] ..... H01F 41/10

[52] U.S. Cl. ..... 29/605; 29/602 R; 29/622; 335/151; 335/202

[58] Field of Search ..... 29/605, 602 R, 622; 335/151–154, 202; 336/198, 208

[56] References Cited

U.S. PATENT DOCUMENTS

| | | | |
|---|---|---|---|
| 2,925,646 | 2/1960 | Walsh | 29/622 X |
| 3,263,043 | 7/1966 | McKeon et al. | 335/202 X |
| 3,539,956 | 11/1970 | Andersen et al. | 335/202 X |
| 3,963,949 | 6/1976 | Church | 310/43 |

*Primary Examiner*—Carl E. Hall

*Attorney, Agent, or Firm*—Wood, Herron & Evans

[57] ABSTRACT

A reed relay and the method of making the same. A bobbin is molded directly onto a glass-encapsulated switch. Simultaneously, the coil terminals are molded into the bobbin. The coil is wound on the bobbin and the leads connected to the coil terminal. Shrink tubing is placed over the assembly and treated to shrink it in place covering the coil.

4 Claims, 8 Drawing Figures

METHOD OF MAKING A REED RELAY WITH MOLDED BOBBIN

This invention relates to a reed relay and the method of making a reed relay.

Conventionally, reed relays are manufactured by forming an elongated glass-encapsulated switch; separately molding a bobbin; winding a coil on the bobbin; inserting the switch in the bobbin; and providing means to immobilize the switch leads with respect to the bobbin so that they can be manipulated into the proper orientation for application to a printed circuit board or the like. Several approaches have been made to the immobilization of the switch leads. They may, for example, be soldered to terminals on the bobbin. They may be gripped by a switch housing as shown, for example, in my copending U.S. /application Ser. No. 784,274, filed Apr. 4, 1977. They may be immobilized by molding an insulative housing around the complete assembly as in the case of the more expensive types of reed relays.

An objective of the present invention has been to provide an improved process for manufacturing a reed relay including a reduction of the number of steps in the manufacturing process.

Another objective of the invention has been to provide an improved switch and reed relay assembly wherein the switch leads are immobilized by having been molded into a bobbin surround-the glass-encapsulated switch and are thus protected from injury arising out of further manipulation of the leads.

The objectives of the present invention are attained in part by molding the coil bobbin directly onto the glass-encapsulated switch. This process of itself constitutes an improvement in reducing to one step that which had formerly been a two-step process. More specifically, formerly the bobbin had been molded as a separate element and the switch was carefully inserted by hand in a bore in the bobbin. Through the present invention, the inserting step has been eliminated.

An improved assembly of switch and bobbin arises out of the process since in the molding process the plastic forms all around the glass envelope as well as a short portion of each lead projecting from the end of the glass envelope. Thus, in the assembly the leads are securely immobilized with respect to the bobbin and glass envelope and no additional steps are required for the immobilization of the leads.

Preferably, the bobbin is molded with a circular flange at each end, one of the flanges having V-shaped notches in which laterally-projecting legs of L-shaped coil terminals are disposed. The laterally-projecting legs are initially accessible for the securing of the ends of the coil to the legs and soldering them. Thereafter, the laterally-projecting legs are swung toward each other within the notches so that they lie substantially entirely within the perimeter of the flange. When shrink tubing is thereafter applied to the assembly, a neat, final reed relay package is provided.

The several features and objectives of the invention will become more readily apparent from the following detailed description taken in conjunction with the accompanying drawings in which.

While the invention will be described primarily in relation to a single switch molded in a single bobbin, it should be understood that the invention has equal application to an assembly of two or more switches in a single bobbin such as the two pole relay of FIG. 8.

Figure 1:
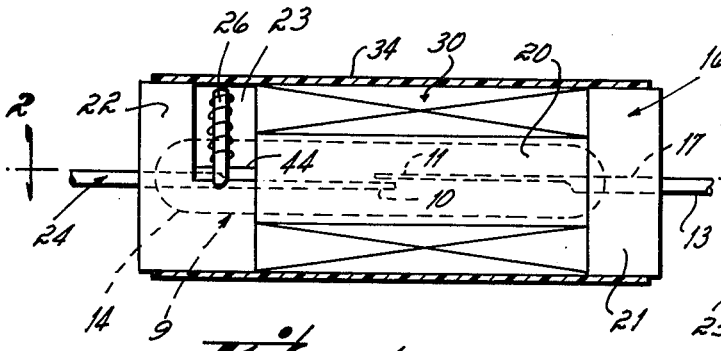
FIG. 1 is a side elevational view of a reed relay formed in accordance with the present invention.
Figure 2:
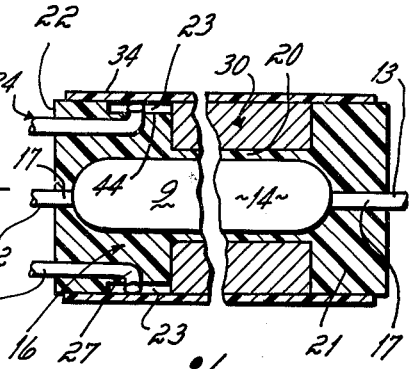
FIG. 2 is a cross-sectional view taken along lines 2—2 of FIG. 1.

A relay formed in accordance with the present invention is illustrated in FIGS. 1 and 2. The relay includes a switch 9 having a pair of contacts 10 and 11 which are integral with switch leads 12 and 13. The contacts are encapsulated in a glass envelope 14.

The glass envelope is completely surrounded by a plastic bobbin 16 which is molded directly to the switch 9, the bobbin extending a substantial distance byond the ends of the envelope so as to surround a portion 17 of the leads 12 and 13 which are immediately adjacent the ends of the glass envelope 14.

The bobbin has a central barrel 20 and a flange 21 at one end of the barrel and a flange 22 at the other end of the barrel. The flange 22 has inwardly-facing recesses or notches 23.

L-shaped coil terminals 24 are disposed in the flange 22, the coil terminals having a longitudinal leg 25 and lateral legs or horns 26 projecting at right angles to the longitudinal legs. The joint or elbow 27 between legs 25 and 26 is embedded in the flange 22. The longitudinal legs project through the flange at a location immediately adjacent the notches 23.

A coil 30 is wound upon the barrel portion of the bobbin and its ends are soldered to respective horns 26 of the coil terminals. The horns 26 are positioned tangentially within the notches 23 so as to lie substantially entirely within the perimeter of the flange 22.

A sleeve of shrink tubing 34 is applied to the outer surface of the assembly thus described and is shrunk into position to enclose the coil and horns of the relay.

In this form the integrity of the component parts of the relay is protected. The switch leads 12 and 13 have portions 17 embedded in the bobbin so that the leads 12 and 13 may be flexed into any desired position for application to the circuit to which the relay is applied. Similarly, the coil terminals are embedded in the bobbin flange 22 so as to be capable of being flexed without disturbing the connection of the coil leads to the terminals. Further, embedding the elbow 27 of the coil terminals in flange 22 prevents distrubing the connection of the horns 26 to the coil leads by external manipulation of the coil terminals.

Still further, the horns 26 lie substantially within the perimeter of the flange 22 so that they may be convered by the sleeve 34 which is shrunk over the length of the relay.

The process of making the relay is illustrated in FIGS. 3–7.

Figure 3:
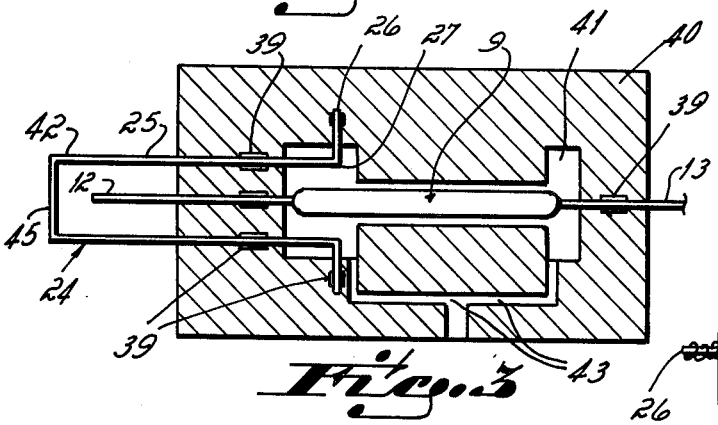
FIG. 3 is a diagrammatic plan view of a mold half used in the process of the invention.

As diagrammatically shown in FIG. 3, a mold half 40 having a cavity 41 of the configuration of the bobbin is adapted to receive the glass-encapsulated switch 9 with the leads 12 and 13 lying in shallow troughs in the mold half. The leads are captured in guides 39. A U-shaped element 42 which will form the coil terminals is placed on the mold half with the horns 26 laterally projecting into the area which will form the flange 22 of the bobbin. The U-shaped element is also captured in guides 39. Conventional ports 43 are provided for the introduction of plastic into the mold. The upper mold half is, of course, similarly formed to mate with the lower mold half 40.

With the switch 9 and U-shaped element 42 in place, the mold is closed and plastic is injected to mold the bobbin 16 directly onto the switch 9 and coil terminals.

Figure 4:
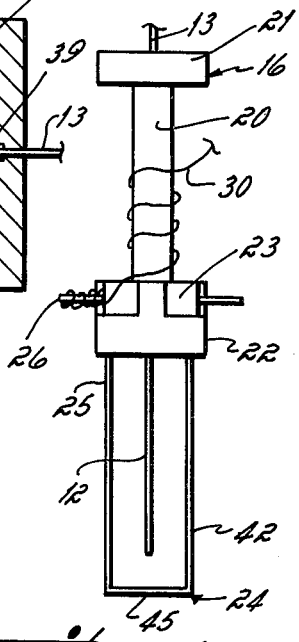
FIGS. 4–7 are diagrammatic illustrations of the sequence of steps in completing the formation of the reed relay.
Figure 5:
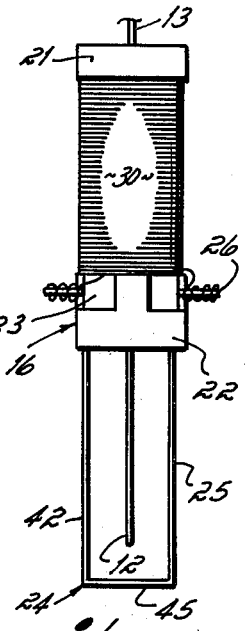
Figure 6:
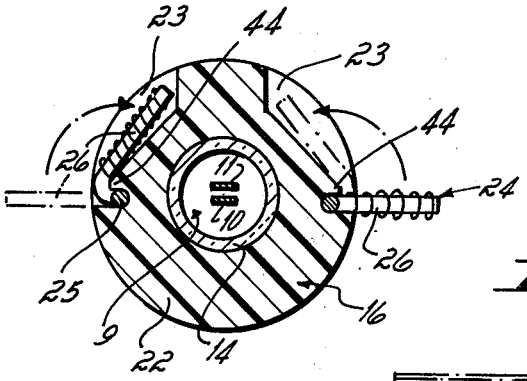

Referring to FIG. 4, the bobbin and switch assembly is shown removed from the mold, and the coil 30 is being wound onto the bobbin. After the coil is wound on the bobbin with a sufficient number of turns, the coil leads are wrapped around the horns 26, as shown in FIG. 5. The connection of the coil leads to the horns is completed by dipping them in molten solder. As shown in FIG. 5, the horns 26 project laterally from the bobbin flange 22. However, upon completing the soldering of the ends, they are swung inwardly within the notches 23 in flange 22 to the orientation shown in FIG. 6. In swinging the horns into the notches, the horns are bent around a projection 44 in the bobbin flange and thus somewhat foreshortened. Through this structure the laterally-projecting horns are long enough for convenient application of the coil leads but short enough to lie in the notches 23 without a separate snipping operation. It can be seen that the horns 26 lie substantially within the perimeter of the flange 22 and are thus protected.

Figure 7:
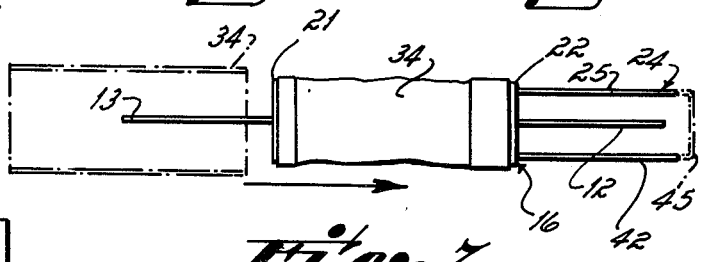

The U-shaped element 42 has a bight portion 45 which is removed as illustrated in FIG. 7. Thus, the coil terminals are electrically isolated from each other except for their connection to the coil. The sleeve of shrink tubing 34 is slid over the bobbin and coil so that its ends overlie the flanges 21 and 22. Upon shrinking the tubing, the tubing covers the coil and horns, thereby providing a neat package ready for application in an electrical circuit.

As has been stated above, no additional steps are required to immobilize the switch leads with respect to the bobbin and thus the switch leads and terminals may be flexed with respect to the assembly without concern of damage to any portion of the relay.

Figure 8:
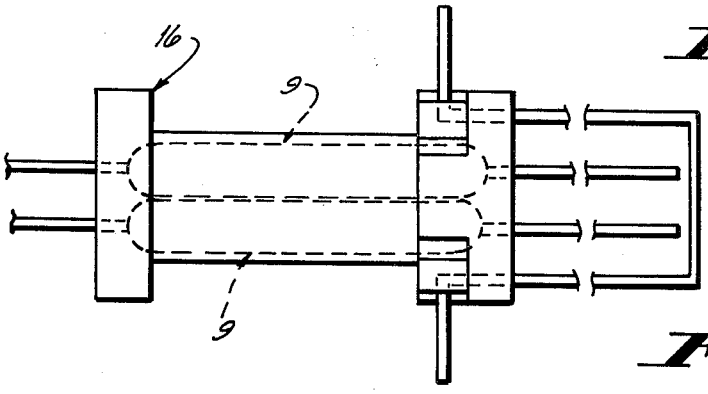
FIG. 8 is a plan view of a two pole relay formed in accordance with the present invention.

As shown in FIG. 8, a two-pole relay may be formed in the manner just described. The only significant difference in the process and structure is that the two-pole relay has two switches 9 molded into the bobbin.

Having described my invention, I claim:

1. The method of forming a reed relay using a mold having a cavity therein comprising the steps of:

placing a switch enclosed in a glass envelope in the mold with leads projecting longitudinally beyond the mold cavity, placing coil terminals in the mold with horns projecting laterally and legs projecting longitudinally beyond said mold cavity, injecting plastic into said mold cavity to surround said glass envelope and a portion of the switch leads and coil terminals adjacent said glass envelope to form a bobbin around said envelope and around portions of the switch leads and the coil terminals, winding a coil on said bobbin and securing the ends of said coil to said horns.

2. The method of assembling a reed relay comprising the steps of:

molding a coil bobbin directly onto a glass-encapsulated switch, simultaneously molding coil terminals into said bobbin, said coil terminals initially being U-shaped and having laterally-projecting horns adjacent one end of said switch, said bobbin being molded around said terminals intermediate the ends thereof to present said horns projecting laterally of said bobbin and a U-shaped portion extending longitudinally out of the end of said bobbin, removing the bight portion of said U-shaped portion, and winding a coil on said bobbin.

3. The method of assembling a reed relay comprising the steps of:

molding a coil bobbin directly onto a glass-encapsulated switch, said bobbin having a flange at one end, said flange having two notches, said molding step further including the step of molding coil terminals into said flange with horns projecting laterally adjacent said notches, winding a coil on said bobbin with ends of said coil wrapped onto said horns, applying solder to said horns, and swinging said horns within said notches from a laterally-projecting orientation to a generally tangential orientation to lie substantially entirely within the perimeter of said flange.

4. The method as in claim 3 wherein said flange has a projection adjacent said notches, said horns being bent around said projections, thus shortening then so that they lie within the notches.

* * * * *